United States Patent [19]

Otto, Jr.

[11] 4,235,850

[45] Nov. 25, 1980

[54] PROCESS FOR THE RECOVERY OF URANIUM FROM A SALINE LIXIVIANT

[75] Inventor: John B. Otto, Jr., Dallas, Tex.

[73] Assignee: Mobil Oil Corporation, New York, N.Y.

[21] Appl. No.: 931,714

[22] Filed: Aug. 7, 1978

[51] Int. Cl.[2] ..... C01G 43/00; C02B 1/60

[52] U.S. Cl. ..... 423/7; 423/17

[58] Field of Search ..... 423/7, 17

[56] References Cited

U.S. PATENT DOCUMENTS

| | | | |
|---|---|---|---|
| 2,841,468 | 7/1958 | Wilson | 423/7 |
| 2,877,089 | 3/1959 | McLean | 423/7 |
| 2,900,227 | 8/1959 | Dancy et al. | 423/7 |
| 3,157,462 | 11/1964 | Henrickson | 423/7 |
| 4,155,982 | 5/1979 | Hunkin et al. | 423/7 |

*Primary Examiner*—Brooks H. Hunt

*Attorney, Agent, or Firm*—C. A. Huggett; William D. Jackson

[57] ABSTRACT

A process for the recovery of uranium from a saline alkaline lixiviant employed in a uranium leaching operation. An ion exchange resin is employed to adsorb uranium from the lixiviant. Prior to contacting the resin with the lixiviant, the pH of the lixiviant is reduced to a value of less than 7. By this technique, the resin loading in the presence of chloride ion is materially increased. The pH values for optimum resin loading capacity decrease as the salinity of the lixiviant increases. Resin loading is also enhanced by the presence of bicarbonate ion in the lixiviant.

11 Claims, No Drawings

PROCESS FOR THE RECOVERY OF URANIUM FROM A SALINE LIXIVIANT

BACKGROUND OF THE INVENTION

This invention relates to the production of uranium and more particularly to the recovery of uranium from a pregnant alkaline lixiviant by ion exchange adsorption.

Uranium is produced from uranium-bearing ores by various procedures which employ an alkaline lixiviant to leach the uranium from its accompanying gangue material. The leaching operation may be carried out in conjunction with surface milling operations in which uranium ore obtained by mining is crushed and blended prior to leaching, heap leaching of ore piles at the surface of the earth, or in-situ leaching in which the lixiviant is introduced into a subterranean ore deposit and then withdrawn to the surface. Regardless of the leaching operation employed, the pregnant lixiviant is then treated in order to recover the uranium therefrom. One conventional uranium recovery process involves passing the pregnant lixiviant over an anionic ion exchange resin and then eluting the resin with a suitable eluant to desorb the uranium from the resin. The resulting eluate is then treated to precipitate uranium therefrom to produce the familiar "yellowcake".

Procedures for the recovery of uranium from an alkaline lixiviant by anion exchange and subsequent elution are disclosed in U.S. Pat. Nos. 2,811,412 to Poirier, 2,841,468 to Wilson, and 2,982,605 to Mouret et al. Typically, the alkaline lixiviant contains alkali metal or ammonium carbonates or bicarbonates or mixtures thereof which function to solubilize hexavalent uranium in the ore as uranyl anionic complexes such as uranyl tricarbonate ions. The pH of the lixiviant normally is within the range of about 8 to 10. However, as disclosed by the aforementioned patents to Mouret et al. and Wilson, somewhat higher pH's are preferred in order to optimize adsorption of the uranium by the ion exchange resin. Thus, the patent to Mouret et al. teaches that the pH should range from 9.5 to 11.5 and preferably be equal to 10.5. The patent to Wilson discloses that the pH should be increased from a value of less than 10 to a value within a range of 10.8 to 11.8 in order to optimize the adsorption of uranium with respect to vanadium. Thus, Wilson discloses that at pH's of 6.9 and 8.9 the ion exchange resin preferentially adsorbs vanadium whereas at a higher pH of 11.2 the resin is selective with respect to uranium with very little vanadium being adsorbed.

SUMMARY OF THE INVENTION

The present invention provides a new and improved process for the recovery of uranium from a saline alkaline lixiviant by adsorption with an anionic ion exchange resin. In accordance with the invention, prior to contacting the resin with the pregnant lixiviant, the lixiviant is acidified in order to reduce the pH to a value less than 7. Preferably, the pH of the pregnant lixiviant is reduced to a value of 6 or less prior to flowing the lixiviant to the ion exchange column. By thus converting the alkaline lixiviant to an acid environment, the adsorption of the uranium onto the resin in the presence of an inorganic salt such as sodium chloride is significantly enhanced.

DESCRIPTION OF THE SPECIFIC EMBODIMENTS

The anion exchange resins employed for uranium concentration are characterized by fixed cationic adsorption sites in which the mobile anion, typically chloride or another halide, is exchanged by the uranyl complex anion. Such anionic ion exchange resins are disclosed, for example, in Merritt, Robert C., THE EXTRACTIVE METALLURGY OF URANIUM, Colorado School of Mines Research Institute, 1971, pp. 138–147. Suitable anionic ion exchange resins may take the form of polymers or copolymers of styrene substituted with quaternary ammonium groups or polymers or copolymers of pyridine which are quaternized to form pyridinium groups.

As disclosed in Merritt at pages 151–156, the presence of inorganic salts in the pregnant lixiviant tends to reduce adsorption of uranium by the anion exchange resin. Thus, Merritt discloses that high carbonate or bicarbonate concentrations tend to reduce the adsorption of uranium by the resin and thus result in decreased resin loading. Chloride ions and nitrate ions also have a strong inhibiting effect on the adsorption of uranyl ions from the alkaline lixiviant. Thus, Merritt, at page 152, discloses that the resin loading decreases with increasing chloride ion concentration from a value of slightly in excess of 5 pounds of $U_3O_8$ per cubic foot of resin to a level of slightly in excess of 3 pounds per cubic foot at a chloride concentration of 4.0 grams per liter (0.4 weight percent).

In accordance with the present invention, resin loadings from alkaline lixiviants having moderate to high salinities in which the chloride ion concentration inhibits resin loading are significantly increased by reducing the lixiviant pH to a value of less than 7 prior to contact with the ion exchange resin. As noted on page 152 of the aforementioned Merritt reference, a chloride concentration of only 0.2 weight percent reduces the uranium loading capacity of a commercially available ion exchange resin by about 20 percent. However, the present invention enables the attainment of satisfactory resin loadings at chloride concentrations of this level and in environments in which the chloride concentration is increased tenfold or more above this level.

In experimental work relative to the present invention, column tests were carried out employing two commercially available ion exchange resins, "Dowex 21K" available from the Dow Chemical Company and "Ionac A-651" available from the Ionac Chemical Company, Division of Sybron Corporation. Both resins are the chloride form of polystyrene beads substituted with quaternary ammonium groups. The Dowex 21K is a so-called "type I" resin and the cationic adsorption site is provided by a methylene trimethylammonium group. The Ionac A-651 is a "type II" resin in which the cationic adsorption sites are provided by methylene hydroxyethyldimethylammonium groups.

In one suite of experiments, the ion exchange column contained 4 cubic centimeters of resin and the lixiviant was passed through the column at a rate of 0.8 cubic centimeter per minute to provide a residence time of lixiviant in the column of 5 minutes. The lixiviant was formulated from a field brine composed primarily of sodium chloride but having minor amounts of calcium, magnesium, and potassium salts. The chloride concentration of the brine was 3328 weight parts per million or 0.33 weight percent. The results of this experimental work are set forth in Table I in which column 2 identifies the resin employed by the symbols "D" (Dowex 21K) or "I" (Ionac A-651). The third column gives the initial uranium concentration of the pregnant lixiviant expressed as weight parts per million of $U_3O_8$, and the fourth column gives the bicarbonate ion concentration of the pregnant lixiviant in weight parts per million. The pH of the lixiviant is set forth in the fifth column and the resin loading expressed in pounds of $U_3O_8$ per cubic foot of resin is set forth in the sixth column. The seventh column gives the leakage at which the resin loading was obtained. The leakage is the uranium concentration of the barren lixiviant effluent from the resin column expressed as a percent of the initial uranium concentration in the pregnant lixiviant. Since most of the column runs reported herein were terminated prior to maximum loading of the resin, it will be recognized that both the loading and the leakage at which the loading was obtained must be considered in evaluating the experimental results.

As can be seen from an examination of the data presented in Table I, runs 1 and 2 were carried out at an alkaline pH with only marginal loading occurring at 70 percent leakage. In runs 3 through 8, the lixiviant was acidified to the pH values indicated prior to flowing it through the resin column. In runs 3 through 7, acidification was accomplished by saturating the lixiviant with carbon dioxide and in run 8 the pH was further reduced by carbon dioxide saturation plus the addition of hydrochloric acid. In each instance, prior acidification of the lixiviant resulted in a substantial increase in resin loading. Maximum resin loading occurred when the lixiviant was only slightly acidified to a pH of 6.7. Run 4 which was terminated at a leakage of about 52 percent exhibited a loading of 5.3 lb/ft$^3$. However, over the interval of run 4, the leakage as a function of volume of lixiviant passed through the column conformed very closely to that of run 3, indicating that the resin loading at pH of 6.25 was about the same as at the pH of 6.7 employed in run 3. At the lower pH's the loading factors were reduced somewhat but were still satisfactory. It will be noted that in run 7 the initial concentration of the lixiviant was 35 parts per million $U_3O_8$ which is representative of the lixiviant charged to a secondary stage of a multistage column operation. Even with this low uranium concentration, a loading of 1.59 pounds per cubic foot was obtained at a leakage of 20 percent.

TABLE I

| Run | Resin | $U_3O_8$ ppm | $HCO_3^-$ ppm | pH | Loading lb/ft$^3$ | Leakage % |
|---|---|---|---|---|---|---|
| 1 | D | 220 | 450 | 7.75 | 1.36 | 70 |
| 2 | I | 220 | 450 | 7.75 | 1.72 | 70 |
| 3 | D | 220 | 1450 | 6.7 | 6.2 | 70 |
| | | | | | 6.6 | 100 |
| 4 | D | 220 | 1450 | 6.25 | 5.3 | 52 |
| 5 | D | 200 | 1450 | 6.0 | 5.6 | 45 |
| 6 | D | 220 | 1450 | 5.95 | 5.4 | 90 |
| 7 | D | 35 | 1450 | 6.08 | 1.59 | 20 |
| 8 | D | 220 | 1450 | 4.7 | 5.1 | 70 |

Another set of experiments was carried out employing an ion exchange column containing one cubic centimeter of resin. The lixiviant in these tests was passed through the column at a rate of 0.2 cubic centimeter per minute to provide a residence time of 5 minutes. The lixiviant employed in this set of experiments contained sodium chloride, sodium bicarbonate, and minor amounts of calcium and barium salts. The results of this suite of experiments are set forth in Table II in which the second column identifies the resin employed by the above-described legends "D" and "I" and the third column sets forth the chloride ion concentration in weight percent. The fourth column gives the pH at which the lixiviant was passed through the resin column. The fifth column gives the loading in pounds of $U_3O_8$ per cubic foot of resin and the last column gives the percent leakage at which the loading was obtained. It will be noted that the leakages varied widely among the several tests set forth in Table II. Thus, runs 22 and 23 which showed loadings of 1.2 at leakages of 10 percent and 2 percent, respectively, would of course indicate significantly higher resin loading capacities than in the case of run 21 where a loading of 1.2 was observed at a leakage of 100 percent. In each of the runs, the lixiviant initially contained about 1300 parts per million bicarbonate ion. In runs 15 through 21, additional sodium bicarbonate or sodium carbonate was added as indicated by footnotes a through e. In runs 11 through 24, the pregnant lixiviant had an initial uranium concentration expressed as $U_3O_8$ of 104 parts per million. In runs 25 through 28, this initial concentration was 136 parts per million.

In reviewing the data set forth in Table II, it can be seen that, where the lixiviant had a chloride concentration of about 0.5 weight percent, loading factors of about 0.5 or slightly above were observed at the slightly basic pH's of about 8 to 8.5. Where the chloride concentration was increased to about 1.5 weight percent and above up to 5.0 weight percent, practically no loading was observed even at leakage rates approaching 100 percent.

TABLE II

| Run | Resin | $Cl^-$, % | pH | Loading lb/ft$^3$ | Leakage % |
|---|---|---|---|---|---|
| 11 | D | 0.54 | 8–8.5 | .49 | 85 |
| 12 | D | 1.5 | 8–8.5 | .01 | 99 |
| 13 | D | 3.0 | 8–8.5 | .01 | 98 |
| 14 | D | 5.0 | 8–8.5 | .01 | 96 |
| 15[a] | D | 0.54 | 8–8.5 | .56 | 72 |
| 16[b] | D | 0.54 | 8–8.5 | .69 | 61 |
| 17[c] | D | 0.54 | 8.2 | .52 | 90 |
| 18[d] | D | 0.54 | 11.0 | 1.14 | 92 |
| 19[e] | D | 0.54 | 11.0 | .81 | 60 |
| 20[d] | D | 0.54 | 11.0 | .76 | 40 |
| 21[d] | I | 0.54 | 11.0 | 1.2 | 100 |
| 22 | D | 0.54 | 6.0 | 1.2 | 10 |
| 23 | I | 0.54 | 6.0 | 1.2 | 2 |
| 24 | D | 0.54 | 6.0 | 1.1 | 10 |
| 25 | I | 1.19 | 6.0 | 3.0 | 40 |
| 26 | D | 1.19 | 6.0 | 2.6 | 40 |
| 27 | I | 2.19 | 6.0 | 1.5 | 70 |
| 28 | D | 2.19 | 6.0 | 1.2 | 80 |

[a]2000 ppm $NaHCO_3$
[b]6000 ppm $NaHCO_3$
[c]25,000 ppm $NaHCO_3$
[d]2000 ppm $Na_2CO_3 \cdot H_2O$
[e]6000 ppm $Na_2CO_3 \cdot H_2O$ In runs 18 through 21, the pH was increased to a value of 11 as taught, for example, in the aforementioned patents to Wilson and Mouret et al. This resulted in a modest increase in resin loading. These runs may be compared with runs 22 through 24 which showed a significantly increased resin loading capacity upon reducing the pH to a level of 6. It will be recalled here that the resin loadings recorded were observed at much lower leakages in runs 22 through 24 than in runs 18 through 21. In runs 22 and 23, the pH was reduced by saturating the lixiviant with carbon dioxide. In run 24, carbon dioxide was not employed and sufficient sulfuric acid was added to reduce the pH to a level of 6. Runs 25 through 28 illustrate the effect of acidifying the lixiviant in the presence of significantly higher chloride ion concentrations of 1.19 and 2.19 weight percent. In each of these tests, acidification was accomplished by dissolving carbon dioxide in the lixiviant and then adding sufficient sulfuric acid to arrive at the indicated pH.

The data presented in Table II may be considered in light of further experimental work set forth in Table III in which batch testing procedures were employed to obtain static adsorption measurements. The adsorption measurements were obtained by placing the aqueous lixiviant solution in a container of resin and stirring the resin-livixiant suspension for periods of from 2 to 3 days to reach an adsorption-desorption equilibrium condition. At the conclusion of this period, the supernatant solution representative of barren lixiviant was analyzed for the amount of uranium remaining in solution and from this data the amount of uranium adsorbed by the resin was calculated. While the batch adsorption experiments are not considered to simulate the operation of an ion exchange column as closely as the column tests reported in Tables I and II, they do give a relative indication of the effect of pH and chloride ion concentration, although the apparent resin loadings may be somewhat higher than those actually obtained in column operations. In these batch experiments, the lixiviant employed was formulated from the same water as that employed in the column tests of Table II and contained 140 parts per million $U_3O_8$ and about 1300 parts per million bicarbonate ion. In each test, 1 cubic centimeter of Ionac A-651 resin was suspended in 500 cubic centimeters of lixiviant and the resulting mixture stirred as indicated above. The results of the batch testing procedures are set forth in Table III in the same format as employed in Table II. Thus, Table III identifies the resin employed, the chloride ion concentration and pH of the lixiviant, and the resin loading in pounds per cubic foot and the leakage at which the resin loading was obtained. For these batch experiments, the leakage was calculated as the uranium concentration remaining in aqueous solution at the conclusion of the adsorption test expressed as a percent of the uranium concentration in the lixiviant at the start of the test. In each of runs B-1 through B-5, the lixiviant was acidified by saturation with carbon dioxide and the addition of sufficient sulfuric acid to arrive at the indicated pH.

TABLE III

| Run | Resin | $Cl^-$ % | pH | Loading lb/ft$^3$ | Leakage % |
|---|---|---|---|---|---|
| B-1 | I | 2.2 | 6.0 | 1.82 | 58 |
| B-2 | I | 2.2 | 5.6 | 3.32 | 24 |
| B-3 | I | 2.2 | 4.9 | 3.96 | 9 |
| B-4 | I | 2.2 | 4.6 | 3.68 | 16 |
| B-5 | I | 2.2 | 4.3 | 2.92 | 33 |

When runs 25 through 28 (Table II) and runs B-1 through B-5 (Table III) are considered in view of runs 22 through 24 (Table II) and runs 3 through 8 (Table I), it can be seen that the pH values for optimum resin loading capacity decrease as the salinity increases. Thus for the salinity levels ranging from about 0.3 weight percent chloride ion upwards, significant increases in resin loading capacities were observed throughout the acid pH range over which the tests were made. However, for the moderately saline solutions, e.g. chloride ion concentrations of less than about 1.0 weight percent, the best resin loadings were observed to occur at acid pH's of 6 or more. For the more saline solutions, the best resin loadings were observed to occur at the lower pH's. Thus, in one embodiment of the invention, the pH of the lixiviant is reduced to a value of 6.0 or less particularly where the chloride ion concentration of the lixiviant is 1.0 weight percent or more. In a further embodiment of the invention, the pH of the lixiviant is reduced to a value of 5.0 or less prior to contact with the ion exchange resin. While satisfactory resin loading occurs at this pH with a moderately saline lixiviant as indicated by run 8 of Table I, operating within this lower pH range is particularly useful for the more saline lixiviants having a chloride ion concentration of 2.0 weight percent or more. The experimental data set forth in Tables I, II, and III indicate that satisfactory resin loadings can be achieved at significantly lower pH values. However, even for the highly saline solutions, the optimum pH would appear to be within the range of 4 to 5; and as a practical matter it normally will be desirable to operate at a lower pH limit of about 4, particularly where the barren lixiviant from the ion exchange column is to be employed in regenerating fresh alkaline lixiviant for the leaching procedure.

In most alkaline leaching procedures, the lixiviant contains an alkali metal or ammonium bicarbonate, usually sodium bicarbonate, or a mixture of bicarbonate and carbonate. In the present invention, the enhanced resin loading capacity achieved by acidifying the lixiviant is influenced by the bicarbonate ion concentration of the pregnant lixiviant as well as by the chloride ion concentration. The relationship between bicarbonate ion and chloride ion concentration and resin loading are illustrated by additional batch experiments in which static adsorption measurements were obtained for aqueous solutions of uranium containing various chloride ion and bicarbonate ion concentrations.

The results of these batch experiments are set forth in Table IV. In these experiments, 1 cubic centimeter of Dowex 21K resin was suspended in 1 liter of lixiviant and the resin suspension was stirred for a period of about 40 hours until equilibrium between the aqueous solution and the resin was achieved. The lixiviants employed had an initial uranium concentration of 250 parts per million calculated as $U_3O_8$ and the chloride concentrations ranged from 0 up to 1.2 weight percent. In Table IV, the second column indicates the chloride ion concentration in weight percent and the third column gives the bicarbonate ion concentration in parts per million. The fourth column sets forth the pH of the lixiviant and the last column sets forth the loading factor in pounds of $U_3O_8$ per cubic foot. From an examination of the data presented in Table IV it can be seen that the presence of some bicarbonate ion in the solution is beneficial and enhances the resin loading. Thus, at chloride ion concentrations of 0.3 or 0.4 weight percent and at pH's ranging from 5.5 to 6.8, it can be seen that resin loading is materially increased by increasing the bicarbonate ion concentration from 363 ppm (run B-18) up to 3631 ppm (run B-12). The effect of intermediate bicarbonate ion concentrations can be seen from runs B-19, B-20, and B-21 in which the lixiviants had bicarbonate ion concentrations of 726, 1452, and 2179 ppm, respectively. Where the lixiviant had a bicarbonate ion concentration of 7262 ppm (B-13), the resin loading declined somewhat from the maximum achieved in run B-12.

TABLE IV

| Run | $Cl^-$ % | $HCO_3^-$ ppm | pH | Loading lb/ft$^3$ |
|---|---|---|---|---|
| B-6 | — | 363 | 8.1 | 7.68 |
| B-7 | — | 726 | 8.0 | 8.02 |
| B-8 | — | 363 | 5.4 | 7.55 |
| B-9 | — | 726 | 5.8 | 8.11 |
| B-10 | .3 | 3631 | 7.9 | 3.45 |
| B-11 | .3 | 7262 | 7.9 | 2.70 |
| B-12 | .3 | 3631 | 6.5 | 8.09 |
| B-13 | .3 | 7262 | 6.8 | 6.50 |
| B-14 | .4 | 363 | 7.9 | 6.91 |
| B-15 | .4 | 726 | 8.0 | 6.18 |
| B-16 | .4 | 1452 | 8.1 | 4.50 |
| B-17 | .4 | 2179 | 8.0 | 4.20 |
| B-18 | .4 | 363 | 5.5 | 5.12 |
| B-19 | .4 | 726 | 5.8 | 5.88 |
| B-20 | .4 | 1452 | 6.0 | 7.50 |
| B-21 | .4 | 2179 | 6.2 | 7.89 |
| B-22 | 1.2 | 726 | 8.0 | 4.88 |
| B-23 | 1.2 | 1452 | 8.1 | 1.95 |
| B-24 | 1.2 | 363 | 5.3 | 4.48 |
| B-25 | 1.2 | 726 | 5.7 | 7.71 |

In view of the relationship between bicarbonate ion concentration and uranium recovery, a preferred application of the present invention is in adsorption of uranium from lixiviants having a bicarbonate ion concentration of 1000 ppm or more. Preferably, the lixiviant has a bicarbonate ion concentration of at least 2000 ppm with the optimum resin loading occurring within the range of 2000–4000 ppm bicarbonate ion.

Although less data is available for the more saline lixiviants, it will be noted that runs B-24 and B-25 in which the lixiviant had a chloride ion concentration of 1.2 weight percent similarly showed that the presence of bicarbonate ion had a favorable impact upon resin loading. It may be noted that a reverse relationship between bicarbonate ion and resin loading was observed for the adsorption tests carried out at alkaline pH's. Thus, tests B-10, B-11, and B-14 through B-17 indicate that the presence of bicarbonate ion in the lixiviant had an adverse impact on resin loading with the maximum resin loadings occurring at bicarbonate ion concentrations of less than 1000 ppm.

As indicated previously, the acidification of the lixiviant in accordance with the present invention can be accomplished by any suitable technique such as by dissolving carbon dioxide in the lixiviant or by adding a mineral acid such as hydrochloric or sulfuric acid or by employing both carbon dioxide and acid. Preferably the acidification step is accomplished by the use of carbon dioxide either alone, or where relatively low pH's on the order of 5 or less are required, in combination with a mineral acid. The use of carbon dioxide is particularly advantageous where it is desirable to operate the leaching process as a closed loop system in which barren lixiviant is employed to regenerate fresh lixiviant for the leaching procedure. In this regard, fresh lixiviant can be regenerated by adding an appropriate base such as sodium hydroxide to the effluent from the resin column to produce bicarbonate ion in solution and arrive at the desired pH.

The present invention may be employed in conjunction with any type of leaching operation such as mill leaching, heap leaching, or in-situ leaching. The invention is particularly applicable for use in conjunction with in-situ leaching operations which often involve the use of relatively saline lixiviants. The in-situ leaching procedure may be carried out utilizing injection and production systems as defined by any suitable well arrangement. One suitable well arrangement is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically, the spacing between injection and production wells is on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

In the in-situ leaching operation, the alkaline lixiviant containing suitable oxidants such as hydrogen peroxide or sodium chlorate is introduced into the subterranean uranium body via the injection system. The lixiviant is displaced through a desired portion of the deposit to solubilize uranium values and the pregnant lixiviant is then withdrawn through the production system to the surface. The pregnant lixiviant is then passed to an acidizing zone where the pH is adjusted to the appropriate level, preferably employing carbon dioxide. The acidified lixiviant is then passed through one or more ion exchange columns operated in accordance with any suitable procedure. For example, the ion exchange columns may be operated in the "fixed bed" mode or in the "moving bed" mode as described for example in the aforementioned book by Merritt at page 167, et seq. The barren lixiviant from the ion exchange column is then circulated to a blending zone where sodium hydroxide or other suitable base is added to adjust the lixiviant to the proper alkaline pH. Oxidizing agents such as hydrogen peroxide or sodium chlorate or mixtures thereof may be added to the lixiviant in the blending zone. Thereafter, the regenerated fresh lixiviant is introduced into the subterranean ore body. The ion exchange column may be eluted by any suitable technique such as disclosed, for example, in the aforementioned patents to Poirier and Mouret et al. and the resultant eluant then treated to recover the uranium.

I claim:

1. In a method for the recovery of uranium from a saline alkaline lixiviant wherein an anionic ion exchange resin is contacted with said lixiviant to adsorb uranium, the improvement comprising reducing the pH of said lixiviant to a value less than 7 prior to contacting said ion exchange resin with said lixiviant.

2. The method of claim 1 wherein carbon dioxide is dissolved in said lixiviant to reduce the pH thereof.

3. The method of claim 1 wherein said lixiviant contains bicarbonate ion in a concentration of at least 1000 parts per million.

4. The method of claim 3 wherein the bicarbonate ion concentration of said lixiviant is at least 2000 parts per million.

5. The method of claim 3 wherein the bicarbonate ion concentration of said lixiviant is within the range of 2000–4000 parts per million.

6. The method of claim 1 wherein the pH of said lixiviant is reduced to a value no lower than 6.0.

7. The method of claim 6 wherein said lixiviant has a chloride ion concentration of less than 1.0 weight percent.

8. The method of claim 1 wherein the pH of said lixiviant is reduced to a value of 6.0 or less.

9. The method of claim 8 wherein said lixiviant has a chloride ion concentration of at least 1.0 weight percent.

10. The method of claim 1 wherein the pH of said lixiviant is reduced to a value of 5.0 or less.

11. The method of claim 10 wherein said lixiviant has a chloride ion concentration of at least 2.0 weight percent.

* * * * *